United States Patent [19]

Semel

[11] 4,080,225

[45] Mar. 21, 1978

[54] LOW TEMPERATURE, WELDABLE, LOW ALLOY STEEL

[75] Inventor: Frederick J. Semel, Philadelphia, Pa.

[73] Assignee: Alan Wood Steel Company, Conshohocken, Pa.

[21] Appl. No.: 730,938

[22] Filed: Oct. 8, 1976

[51] Int. Cl.[2] ..... C22C 38/06; C22C 38/12; C22C 38/16

[52] U.S. Cl. ..... 148/36; 75/124; 75/125; 148/12 F

[58] Field of Search ..... 75/123 B, 123 J, 123 K, 75/123, 124; 148/12 F, 36

[56] References Cited

U.S. PATENT DOCUMENTS

| | | | |
|---|---|---|---|
| 3,310,441 | 3/1967 | Mandich | 75/125 |
| 3,328,211 | 6/1967 | Nakamura | 148/12 F |
| 3,592,633 | 7/1971 | Osuka et al. | 75/124 |
| 3,795,508 | 3/1974 | Tanaka et al. | 75/125 |

FOREIGN PATENT DOCUMENTS

| | | | |
|---|---|---|---|
| 46-27131 | 8/1971 | Japan | 75/125 |

*Primary Examiner*—Arthur J. Steiner
*Attorney, Agent, or Firm*—Joseph Gray Jackson; Edward Lovett Jackson; Eugene Chovanes

[57] ABSTRACT

The invention involves a steel and the process of making it, which steel is especially adapted for welding at good productivity to produce a product well able to meet the special low temperature requirements for such purposes as ships for transporting liquified natural gas, without departing from normal steelmaking and rolling practices beyond ordinary normalizing. The steel for this and other reasonably similar purposes will have the following composition range:

| | Percent | Preferred Percent |
|---|---|---|
| Carbon | 0.04 to 0.12 | 0.06 to 0.10 |
| Manganese | 0.30 to 0.90 | 0.65 to 0.85 |
| Silicon | 0.15 to 0.50 | 0.20 to 0.35 |
| Nickel | 0.15 to 0.50 | |
| Copper | 0.15 to 0.40 | |
| Aluminum (acid soluble) | 0.020 to 0.090 | |
| Aluminum (total) | 0.025 to 0.100 | |
| Niobium (Columbium) | 0.020 to 0.060 | 0.035 to 0.055 |
| Iron and impurities, balance | | |

2 Claims, No Drawings

LOW TEMPERATURE, WELDABLE, LOW ALLOY STEEL

DESCRIPTION

The present invention relates to a low temperature, weldable steel and process of making it.

The energy crisis and resulting energy related applications have created the need for new and improved steels. One such important application is the construction of a fleet of ships to transport liquified natural gas. Since portions of the hull and bulkheads of these ships will be exposed to lower temperature service than usual and in view of the critical nature of the cargo, the various ship building regulatory agencies including, for example, the American Bureau of Ships, have established strict specifications governing the steels and methods to be used. Included in these specifications are low temperature impact requirements on plates for use in the range from 0° to minus 57° C and weld procedure qualification requirements for weldments subjected to temperatures in this range. These latter requirements have generally been found to be especially difficult to meet with existing steels. Usually, it has been necessary in welding to employ low heat input and multipass practices. As a consequence, welding productivity has been held far below the capabilities of most shipyard equipment and facilities. Thus, it will be appreciated that it is urgently needed to develop a steel with improved characteristics.

The welding qualification requirements mentioned are designed not only to check the integrity of the weld itself but also to ensure that satisfactory toughness has been maintained within the heat affected zone. Typically included are room temperature tensile and guided bend tests plus a series of low temperature Charpy V-notch impact tests. Of the three, the impact test requirements are by far the most difficult to meet. For example, tests are made at each of five locations including the center of the weld, on the fusion line, and in the heat affected zone at 1, 3 and 5 mm from the fusion line. The test temperature varies within the aforementioned range according to the design of the ship and particular point of application within the ship. The minimum energy requirement is typically 2.8 Kgm (20 ft-lbs), although it may be higher in some cases. Since steel plate normally exhibits reduced ductility and toughness in the transverse direction, the qualification weldments are usually tested in this direction.

Of the various weldment test locations, the toughness requirements present the greatest difficulty in the heat affected zone, especially on and near the fusion line. The general trend in this region is that the steel's impact resistance undergoes progressive deterioration with approach to the fusion line and very often decreases rather sharply at the fusion line. Such reductions in toughness are a consequence of solid state reactions and attendant microstructural changes occurring during and immediately subsequent to welding. One such reaction, for example, which is notorious for its detrimental effects on impact resistance is grain growth. As is well known, the extent to which grain growth occurs increases with increasing temperature and time. Thus, at least in part, it will be evident why it has been found necessary in welding to limit heat input and use a multipass practice to meet the heat affected zone requirements.

The bulk toughness properties of the steel also influence the toughness through the heat affected zone and these properties are in turn a function of prior processing and alloy composition. In recognition of this, the various shipbuilding regulatory agencies each specify normalizing prior to use and have likewise imposed restrictions on steel composition. For example, the American Bureau of Ships' chemical requirements on steels for service at minus 57° C included the following:

| | Percent |
|---|---|
| Carbon, max. | 0.12 |
| Manganese | 1.30 to 1.65 |
| Phosphorus, max. | 0.04 |
| Sulfur, max. | 0.04 |
| Silicon | 0.10 to 0.35 |
| Nickel, max. | 0.80 |
| Chromium, max. | 0.25 |
| Molybdenum, max. | 0.08 |
| Copper, max. | 0.35 |
| Aluminum (acid soluble) max. | 0.060 |
| Aluminum (total) max. | 0.065 |
| Niobium (Columbium) max. | 0.05 |
| Vanadium, max. | 0.10 |

These requirements are apparently based in part on recommendations of the steel industry and, in part, on preliminary determinations on a variety of steels to establish which were best suited to pass the weld qualification tests.

In many respects, the requirements suggest that the philosophy underlying their selection may have tended to emphasize exceptional toughness in the bulk of the plate to allow for anticipated toughness deterioration in the heat affected zones but otherwise neglected the likely causes of such decreases. For example, the necessity to make the steel with a relatively high manganese content and the allowance of additions of chromium, molybdenum, and vanadium all favor the attainment of exceptionally high impact resistance in normalized steel. However, these same elements, especially the high manganese content and the vanadium, increase the possibility of producing in the heat affected zone relatively hard, low temperature transformation products and dispersion strengthening precipitates which would obviously contribute to toughness losses. Of course, the other elements which are allowed may offset this latter effect. Thus, these requirements may very well admit of a perfectly good steel from the standpoint of both heat affected zone toughness and bulk plate toughness. However, those familiar with the art will appreciate that there exits in the requirements considerable latitude as to the choice of this particular steel.

I have on my own undertaken an analysis of the compositional factors which influence niobium carbide precipitation in low alloy steels. As a consequence of this analysis I have developed a normalized niobium containing low alloy steel which exhibits exceptional low temperature properties. It is also novel in that it is made with a relatively low manganese content and completely avoids the use of chromium, molybdenum, and vanadium except as they may arise as impurities in the steel making process. Thus, compared to existing steels, the present steel is more economical to manufacture and generally less susceptible to gross toughness decreases in the heat affected zones of weld. In addition, by virtue of the presence of copper in the alloy which contributes to the development of its excellent low temperature properties, it also exhibits good corrosion resistance.

The composition limits of the steel by weight are as follows:

| | Percent | Preferred Percent |
|---|---|---|
| Carbon | 0.04 to 0.12 | 0.06 to 0.10 |
| Manganese | 0.30 to 0.90 | 0.65 to 0.85 |
| Silicon | 0.15 to 0.50 | 0.20 to 0.35 |
| Nickel | 0.15 to 0.50 | |
| Copper | 0.15 to 0.40 | |
| Aluminum (acid soluble) | 0.020 to 0.090 | |
| Aluminum (total) | 0.025 to 0.100 | |
| Niobium (Columbium) | 0.020 to 0.060 | 0.035 to 0.055 |
| Iron and impurities, balance | | |

Normal steelmaking and rolling practices are employed in the manufacture of the steel. After cooling to ambient temperatures from rolling to final gauge, the steel plates are subjected to a normalizing heat treatment to develop the desired mechanical properties. The heat treatment consists in heating the plates in air in a furnace to a uniform temperature in the range of 900° to 975° C, preferably 915° to 940° C, for a period of up to 1 hour per 2.5 cm of gauge, and preferably for ½ hour per 2.5 cm of gauge followed by cooling in still air to ambient temperatures.

The steel of the invention is obviously composed of some rather common alloying elements. However, in spite of this, it is novel in comparison with existing low temperature steels. To explain this, it is necessary to describe in detail the special considerations which led to it.

To begin with, no consideration whatsoever was given to the aforementioned American Bureau of Ships chemical requirements in the design of the steel. The reason for this was that there appeared no a priori basis for believing that the high manganese contents which these requirements specify are at all necessary or that the other alloy additions which are allowed are either necessary or desirable. Instead, it was decided to start simply with a low carbon niobium containing steel and to use theory and experiment to develop the balance of the composition. Special consideration was given to the factors which contribute not only to bulk plate toughness but to heat affected zone toughness as well.

In essence, this approach evolved from the idea that the properties attained in a niobium bearing steel are largely dependent upon the thermal characteristics of the precipitation and/or dissolution of the niobium carbide which are, in turn, amenable to overall alloy content. A somewhat more advanced conception along these same lines which additionally includes consideration of precipitation kinetics is set forth in a copending U.S. patent application Ser. No. 730,937 filed Oct. 8, 1976 by me entitled Rolled, Low Carbon, Niobium, Steel which has been executed and filed on the same respective dates as this application. This application describes a steel of substantially higher niobium content for use in the as-rolled condition.

In any case, to elucidate the idea as it applies to the present steel, consider the following hypothetical case. An alloy containing 0.08% carbon and 0.04% niobium with the balance iron and impurities is to be normalized with the objective to refine the grain size and thereby improve toughness. Initially, the steel is in the as-rolled condition and the niobium carbide present exists in the form of an ultra fine dispersion as is typically the case with such steels. Since the objective is grain refinement, the heat treatment would be carried out at the lowest practical temperature compatible with complete austenization, say for example, 927° C (1200° K).

During the heat treatment, the niobium carbide both coarsens and partially dissolves. It is pertinent for two reasons to enquire as to the extent of the dissolution. First, the volume of the carbide dispersion would be decreased in proportion to the amount which dissolves and this would be expected to decrease the dispersion's effectiveness in inhibiting grain growth. Second, the amount which goes into solution also indicates the potential for precipitation strengthening during cooling subsequent to the heat treatment. Since toughness is adversely affected by precipitation strengthening and since the objective of the treatment is to improve toughness, it will be evident that too much such strengthening would be undesirable.

Mori et al. on page 763 of GETSU TO HAGANE, Vol. 54, 1968 have reported on the solubility behavior of niobium carbide in an iron, carbon, niobium alloy. According to their findings, the solubility product constant of the carbide varies with temperature as follows:

$$\text{Log}_{10}[C_C]\,[C_{Nb}] = -7700/T\,(K^\circ) + 3.18 \qquad (1)$$

where $C_C$ and $C_{Nb}$ are the solid solution concentrations in weight percent of carbon and niobium in equilibrium with the carbide at absolute temperature T in degrees Kelvin.

By applying this relation to the alloy under consideration, it can be shown that the niobium content in equilibrium with the carbide at the treatment temperature is 0.008%. This corresponds to a 25% dissolution of the carbide phase.

Obviously, both of these figures are significant. A 25% dissolution will almost certainly decrease the extent to which the dispersion is able to inhibit grain growth. Similarly, it is well known that even as little as 0.005% of niobium in solution can produce appreciable strengthening and thus, the effect of 0.008% as in the present case, would be expected to be substantial.

In view of these findings, it will be evident that it would be potentially advantageous to decrease the extent to which the carbide dissolves. There are three ways to produce this effect:

1. By increasing the carbon content;
2. By decreasing the niobium content; and,
3. By use of the thermodynamic interaction effects of alloying elements other than carbon and niobium.

The first two of these methods are the simplest and best known. However, neither is really compatible with the objective to develop a steel which exhibits good toughness in the heat affected zone as well as in the bulk of the plate. For example, in addition to decreasing the amount of carbide which dissolves, an increase in the carbon content would simultaneously increase the steel's pearlite content. This could very well be equally as detrimental to toughness, if not more so, than the effects which the carbon increase was intended to offset. Alternately, decreasing the niobium content will decrease the amount which goes into solution during heat treatment and thereby reduce the potential for precipitation strengthening on cooling. However, such a decrease will also automatically decrease the volume of the carbide phase and thus, its ability to effect grain refinement. Moreover, the resulting reduction in the product $[C_C]\,[C_{Nb}]$ will in accordance with equation (1) lead to a lowering of the overall carbide solution temperature. A likely consequence of this would be a decrease in the steel's grain coarsening temperature, a totally undesirable effect in view of the objective to minimize or prevent significant toughness deterioration in the heat affected zone of welds.

Thus, these considerations lead to the last method mentioned, that of using the thermodynamic interaction effects of alloying elements other than carbon and niobium. This method is not well known. Whatever the reason for this, since the method is an unfamiliar one, an explanation of its theoretical basis will be of value.

The solid state reaction of interest is $$NbC \rightarrow Nb + C \quad (2)$$

The extent to which this reaction occurs under any set of conditions is determined chiefly by thermodynamics.

To create conditions favoring a reduction in the amount of NbC which dissolves, thermodynamics requires that the product of the chemical activities $A_C$ and $A_{Nb}$ of the constituent elements, carbon and niobium, exceed the solubility product constant $K_a$ of the carbide at the particular temperature T at which the reaction is expected to occur. Mathematically, the activities and solubility product constant are related according to $$[A_C]\,[A_{Nb}] = K_a(T) \quad (3)$$

where the notation $K_a(T)$ denotes that $K_a$ is a function of T the temperature.

The activity of an element in solution is proportional to its concentration C according to the relation in $$A = \gamma C \quad (4)$$

where $\gamma$, the proportionality factor, is called the activity coefficient. Thus, equation (3) may be rewritten as $$[\gamma_C C_C]\,[\gamma_{Nb} C_{Nb}] = [\gamma_c \cdot \gamma_{Nb}]\,[C_C]\,[C_{Nb}] = K_a(T) \quad (5)$$

In dilute solution such as low alloy steel, it is usually found that the activity coefficient of a given element is a constant independent of the concentration of the element itself, (Henry's law). However, its value may be affected by the concentrations of the other elements present, that is, there may be so-called interaction effects. An important peculiarity of interaction effects in regard to intermetallic compounds such as NbC is that while a change in the concentration of any one of the elements which go to form the compound may affect the activity coefficients of the other constituent elements involved and vice versa, the value of the activity coefficient term in the solubility product formula remains unchanged. Thus, equation (5) may be rewritten as $$[C_C]\,[C_{Nb}] = \frac{K_a(T)}{[\gamma C \gamma_{Nb}]} \quad \text{Equation (6)}$$

It is seldom if ever that solubility data are presented in terms of the various thermodynamic quantities contained in the quotient on the right hand side of equation (6). Instead, one typically sees the well-known empirical relation, as in $$[C_C]\,[C_{Nb}] = K_c(T) \quad (7)$$

where $K_c(T)$ is the so-called "concentration solubility product constant."

Comparing equation (6) and (7), it will be evident that $K_a$ and $K_c$ are related according to $$K_c(T) = \frac{K_a(T)}{[\gamma_C \cdot \gamma_{Nb}]} \quad \text{Equation (8)}$$

This relation is important because while it shows that $K_c$ is indeed a constant, it also shows that it is only so in a rather narrow sense. For example, at a specified temperature, $K_a$ is a true constant completely independent of composition. However, the product $[\gamma_C \cdot \gamma_{Nb}]$ is constant only insofar as carbon and niobium are concerned. Otherwise, it is not a constant, being subject to change in accordance with the interaction effects of the other elements which are present. Thus, in view of equation (8), it will be evident that while $K_c$ can be expected to be constant in a particular alloy, its value will in general vary from one alloy to another. More significantly, it will also be evident that this means that independently of carbon and niobium, the tendency for niobium carbide to dissolve is to some extent amenable to alloy content.

To make use of this fact quantitatively, it is necessary to know the interaction effects of the various common alloying elements on both carbon and niobium.

For carbon, data were available on the effects of Mn, Mo, Cr, Ni, Si and V. These data are contained in the following references: R. Williams et al., JOURNAL OF THE IRON AND STEEL INSTITUTE, Vol. 210, 1972, pages 105 to 110. J. C. Greenbank, JOURNAL OF THE IRON AND STEEL INSTITUTE, Vol. 209, 1971, pages 986 to 990. A formal description of interaction parameters and indications as to the likely effects of aluminum on carbon are contained in THERMOCHEMISTRY FOR STEEL-MAKING by J. F. Elliott et al, Vol. 2, 1963, pages 562 to 565.

For niobium, data were available only in the case of Mn, Cr, Ni and Si. These data are contained in a report of work done by S. Koyama et al., published in KINZOKU GAKKAI-SHI, Vol. 35, 1971, pages 1089 to 1094.

Based on these findings, Mn, Mo, Cr and V would be expected to increase the tendency of the carbide to dissolve whereas Ni, Cu, Si and Al would be expected to have the opposite effect. Thus, although these indications were somewhat speculative in that data were not available on the effects of all the elements on niobium, they were nevertheless used to design the steel of the invention. Specifically, it was decided that the steel should be made with reasonably high contents of Ni, Cu, Si and Al and with negligible contents of Mo, Cr and V. Although Mn was also contraindicated, it otherwise has so many beneficial effects, especially in low temperature steel, that it too was included in the composition but at relatively low to moderate levels.

Experiments were now conducted to test the foregoing indications. A special effort was made in this work to simulate as much as possible actual manufacturing conditions. Steels having the alloy compositions of interest were made by modifying, by means of mold additions, 56 × 112 × 203 cm × 8180 Kg hot topped ingots, teemed from 136 metric ton basic oxygen furnace heats made to the following nominal base composition:

| | Percent |
|---|---|
| Carbon, max. | 0.08 |
| Manganese, | 0.60 to 0.80 |

-continued

| | Percent |
|---|---|
| Phosphorus, max. | 0.020 |
| Sulfur, max. | 0.022 |
| Silicon, max. | 0.05 |
| Niobium | 0.03 to 0.05 |
| Aluminum | 0.005 to 0.015 |
| Iron and impurities, balance | |

The base steel represents a practical embodiment of the steels claimed in U.S. Pat. No. 3,721,487 granted to A. G. Allten and F. J. Semel, Mar. 20, 1973 for Low Carbon, Niobium and Aluminum Containing Steel Sheets and Plates and Process.

The processing following teeming was completely normal in all respects. Shortly after solidification was complete, the ingot molds were stripped and the ingots reheated to a temperature in the range of 1250° to 1350° C. When the ingots attained the desired temperature throughout, they were reduced by rolling to the slab or billet form. Immediately following rolling, the unusable portions were removed and the remainder cut hot to the desired sizes. After cooling to ambient temperatures, the several pieces were examined and further processed to remove surface defects and so forth. Subsequently, the pieces were heated for final rolling to a temperature in the range of 1150° to 1250° C.

In final rolling, one or the other of two procedures were used. In one procedure, the slab was rolled parallel to the original longitudinal axis of the ingot until its length coincided with the desired final width of the plate. Thereafter, it was turned through an angle of 90° and rolled to final gauge. This procedure will later be referred to as transverse rolling. In the other procedure, the slab was again initially rolled parallel to the longitudinal axis of the ingot. However, in this case, at a point in the rolling convenient for turning, it was turned 90° and subsequently rolled in the new direction until its length coincided with the desired final plate width. Thereafter, it was turned back to the original direction and finished rolled to gauge. This procedure will be referred to as spread to width rolling.

In other respects, rolling was entirely normal, that is, there was no special control of finishing temperature or use of water sprays either during or subsequent to finishing. After rolling, as-rolled samples were taken for eventual heat treatment under laboratory conditions. The full size plates were also heat treated under mill conditions. The conditions of heat treatment were in both cases as described previously.

EXAMPLE 1

Two ingots, A and B, were modified from the base composition to yield steels having the following analyses:

| | Steel A % | Steel B % |
|---|---|---|
| Carbon | 0.08 | 0.08 |
| Manganese | 0.76 | 0.75 |
| Phosphorus | 0.011 | 0.010 |
| Sulfur | 0.020 | 0.020 |
| Silicon | 0.011 | 0.30 |
| Nickel | 0.030 | 0.26 |
| Copper | 0.11 | 0.21 |
| Aluminum | 0.063 | 0.062 |
| Niobium | 0.045 | 0.044 |
| Iron and impurities | Balance | Balance |

Steel A is merely an aluminum killed version of the base composition. The copper, nickel, and silicon contents of this steel represent normal impurity levels. In contrast, Steel B has intentionally increased contents of silicon, copper, and nickel in addition to being aluminum killed. After solidification each of the special ingots were processed as previously described, eventually being transverse rolled to plate. Two different plate sizes were selected for study: 1.25 × 213 × 610 cm. and 1.90 × 244 × 335 cm.

Test samples from the as-rolled plates were laboratory normalized. Regardless of gauge, normalizing consisted of heating to 915° C, holding for ½ hour at temperature, followed by cooling in still air. The mechanical properties of the normalized samples, including tensile and Charpy V-notch tests, were determined. Standard A.S.T.M. test methods and specimens were used. Metallographic examinations were also conducted to determine the grain sizes of the normalized samples. The results of these tests are shown below.

Tensile and Grain Size Results

| Steel | Gauge mm | Lower Yield Pt. kg/mm² | Tensile Stg. kg/mm² | % Elong. in 50 mm | Mean Grain Dia. mm × 10³ |
|---|---|---|---|---|---|
| A | 12.5 | 32.8 | 41.8 | 33.0 | 10.3 |
| B | 12.5 | 37.2 | 47.0 | 30.0 | 9.0 |
| A | 19.0 | 32.9 | 40.7 | 42.0 | 11.8 |
| B | 19.0 | 35.8 | 46.0 | 40.0 | 11.0 |

Charpy V-Notch Impact Results

| Steel | Gauge mm | Longitudinal Tests Energy in Kgm −40° C | Longitudinal Tests Energy in Kgm −62.5° C | Transverse Tests Energy in Kgm −40° C | Transverse Tests Energy in Kgm −62.5° C |
|---|---|---|---|---|---|
| A | 12.5 | 13.2 | 2.2 | 4.3 | 1.5 |
| B | 12.5 | 16.1 | 13.7 | 13.7 | 10.9 |
| A | 19.0 | 8.0 | 0.8 | 7.3 | 0.8 |
| B | 19.0 | 13.6 | 12.0 | 14.8 | 8.8 |

It will be evident from an examination of these data that the steel of the invention, Steel B, was clearly superior to Steel A in virtually every respect. Most significant, perhaps, was the exceptional low temperature toughness exhibited by Steel B. For example, even in the transverse direction, it was better than three times the American Bureau of Ships minimum requirement on steel for service at minus 57° C. (The test temperature of minus 62.5° C was selected to comply with the American Bureau of Ships rule that the steel be tested 5.5° C below the intended service temperature).

EXAMPLE 2

An ingot, Steel C, was modified from a second heat of the base composition with the following result:

| Steel C | Percent |
|---|---|
| Carbon | 0.08 |
| Manganese | 0.81 |
| Phosphorus | 0.009 |
| Sulfur | 0.021 |
| Silicon | 0.47 |
| Nickel | 0.31 |
| Copper | 0.30 |
| Aluminum | 0.033 |
| Niobium | 0.055 |
| Iron and impurities, | balance |

Compared to Steel B, Steel C is substantially higher in silicon, somewhat higher in nickel, copper, and niobium, and much lower in aluminum.

After solidification, the ingot was processed to produce slabs as previously described. Thereafter, two of the slabs were rolled to plates of the same size, 2.50 × 213 × 508 cm, but using different procedures. One was transverse rolled and the other was spread to width rolled.

Upon cooling to ambient temperatures, both plates were mill normalized at 915° C for 1 hour at temperature, followed by cooling in still air. The mechanical properties of the mill normalized test samples were determined as in Example 1. The results are shown below.

| Condition | Tensile Result Lower Yield Pt. kg/mm² | Tensile Stg. kg/mm² | % Elong. in 50 mm |
|---|---|---|---|
| Transverse Rolled | 35.1 | 45.8 | 38 |
| Spread to Width Rolled | 35.4 | 46.6 | 35 |

| Condition | Charpy V-Notch Impact Results Longitudinal Tests Energy in Kgm −40° C | −62.5° C | Transverse Tests Energy in Kgm −40° C | −62.5° C |
|---|---|---|---|---|
| Transverse Rolled | 14.4 | 7.4 | 12.7 | 8.8 |
| Spread to Width Rolled | DNB* 6.0 | 5.9 | 4.1 | |

*DNB - Did Not Break Energy greater than 33.6 Kgm.

These data add support to the results of Example 1 and further define the composition limits of the steel. They also show that each of the two rolling practices resulted in satisfactory properties. The impact properties of the transverse rolled plate, however, were generally superior to those of the spread to width rolled plate, especially in the all important transverse direction. Thus, transverse rolling would be the preferred practice and spread to width rolling would only be used where practical circumstances dictate.

The particular setup involved in the present application preferably especially involves among other things, in respect to properties of the steel, a steel which has a lower yield point in kilograms per square millimeter at room temperature of at least 34, a tensile strength in kilograms per square millimeter at room temperature of at least 44, a Charpy V-notch impact energy value in longitudinal test at 2.5 centimeter gauge at −62.5° C in kilogram meters of at least 6.0, and Charpy V-notch impact energy value in transverse at 2.5 centimeter gauge at −62.5° C in kilogram meters of at least 6.0 when transverse rolled and 3.0 when spread to width rolled.

In the specification and claims, where the word "casting" is used, this includes both ingots and other things which originate by the process of casting, including continuous casting.

In view of my invention and disclosure, variations and modifications to meet individual whim or particular need will doubtless become evident to others skilled in the art to obtain all or part of the benefits of my invention without copying the process and structure shown, and I, therefore, claim all such insofar as they fall within the reasonable spirit and scope of my claims.

Having thus described my invention what I claim as new and desire to secure by Letters Patent is:

1. A steel in the as-rolled and then normalized condition, which has properties well adapted for welding, having a Charpy V-notch impact energy value in transverse test at 2.5 centimeter gauge at −62.5° C consisting essentially of the following in traverse rolled and 3.0 when spread to width rolled and consisting essentially of the following in percentages by weight:

| | |
|---|---|
| Carbon | 0.04 to 0.12 |
| Manganese | 0.30 to 0.90 |
| Silicon | 0.15 to 0.50 |
| Nickel | 0.15 to 0.50 |
| Copper | 0.15 to 0.40 |
| Aluminum (acid soluble) | 0.020 to 0.090 |
| Aluminum (total) | 0.025 to 0.100 |
| Niobium (Columbium) | 0.060 to 0.060 |

2. A steel especially suited for welding in situations requiring good low temperature characteristics, constituting a steel in the as-rolled and then normalized condition having a Charpy V-notch impact energy value in transverse test at 2.5 centimeter gauge at −62.5° C in kilogram meters of at least 6.0 when transverse rolled and 3.0 when spread to width rolled and having as its composition a composition consisting essentially of the following in percentages by weight:

| | |
|---|---|
| Carbon | 0.06 to 0.10 |
| Manganese | 0.65 to 0.85 |
| Silicon | 0.20 to 0.35 |
| Nickel | 0.15 to 0.50 |
| Copper | 0.15 to 0.40 |
| Aluminum (acid soluble) | 0.020 to 0.090 |
| Aluminum (total) | 0.025 to 0.100 |
| Niobium (Columbium) | 0.035 to 0.055 |
| Iron and impurities | Balance |

* * * * *

UNITED STATES PATENT OFFICE

CERTIFICATE OF CORRECTION

Patent No. 4,080,225 Dated March 21, 1978

Inventor(s) Frederick J. Semel

It is certified that error appears in the above-identified patent and that said Letters Patent are hereby corrected as shown below:

Column 10, lines 19-20: delete "consisting essentially of the following in" and substitute: - in kilogram meters of at least 6.0 when - .

Column 10, line 31, change "0.060 to 0.060" to - 0.020 to 0.060 - .

Column 10, after line 31 insert the following line: - Iron and impurities Balance - .

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*